US005965279A

United States Patent [19]

Yu

[11] Patent Number: 5,965,279

[45] **Date of Patent: *Oct. 12, 1999**

[54] ELECTRICAL CONDUCTOR MADE OF COPPER-PLATED AND TIN-PLATED ALUMINUM

[75] Inventor: Ning Yu, Montmirail, France

[73] Assignee: Axon'Cable SA, Montmirail, France

[ * ] Notice: This patent issued on a continued prosecution application filed under 37 CFR 1.53(d), and is subject to the twenty year patent term provisions of 35 U.S.C. 154(a)(2).

[21] Appl. No.: 08/815,958

[22] Filed: Mar. 13, 1997

Related U.S. Application Data

[62] Division of application No. 08/446,824, filed as application No. PCT/FR93/01148, Nov. 22, 1993, Pat. No. 5,665,219.

[51] Int. Cl.[6] ..... B32B 15/01

[52] U.S. Cl. ..... 428/646; 428/647; 428/650; 428/652; 428/674; 428/935

[58] Field of Search ..... 428/647, 652, 428/674, 646, 650, 935

[56] References Cited

U.S. PATENT DOCUMENTS

| | | | |
|---|---|---|---|
| 2,513,365 | 7/1950 | Rogoff | 173/324 |
| 3,695,854 | 10/1972 | Egger et al. | 29/183.5 |
| 4,126,483 | 11/1978 | Donakowski et al. | 134/3 |
| 4,994,155 | 2/1991 | Toben et al. | 204/28 |
| 5,178,965 | 1/1993 | Tench et al. | 428/612 |
| 5,389,446 | 2/1995 | Yamanishi et al. | 428/472 |
| 5,525,432 | 6/1996 | Do-Thoi et al. | 428/627 |

FOREIGN PATENT DOCUMENTS

| | | |
|---|---|---|
| 2 650 696 | 2/1991 | France . |
| 54-60232 | 5/1979 | Japan . |
| 817144 | 7/1959 | United Kingdom . |

OTHER PUBLICATIONS

"Electroplating on Aluminum Wire", Transactions of the Institute of Metal Finishing, vol. 61, 1983, pp. 67–71.

Electroplating Aluminum — A Controllable Process, by Harold Shapiro, "Metal Finishing", Feb. 1967, pp. 58–61.

Citric, Tartaric and Gluconic Acids in Metal Finishing, by D. C. Horner, "Electroplating and Metal Finishing", Mar. 1968, pp. 75–80.

Methane Sulfonic Acid as an Electrolyte for Tin, Lead and Tin–Lead Plating for Electronics, by Charles Rosenstein, "Metal Finishing", Jan. 1990, pp. 17–21.

*Primary Examiner*—Paul Thibodeau
*Assistant Examiner*—Holly C. Rickman
*Attorney, Agent, or Firm*—Graham & James LLP

[57] ABSTRACT

An electrical conductor consisting of an at least partially aluminium-based central core coated by continuous electrodeposition with at least one metal layer, including pretreatment of the surface of the core, characterized in that the following are subsequently performed successively on the core, a) an electrochemical deposition of copper in an aqueous bath maintained at a temperature of between 20° C. and 60°C., containing KCN, CuCN, $K_2CO_3$ and $KNaC_4H_4O_6$ with a current intensity of between 1 and 10 A/dm$^2$;

b) rinsing at ambient temperature;

c) an electrochemical deposition of tin in an aqueous bath maintained at a temperature of between 20° C. and 60° C., containing essentially tin dissolved in methanesulphonic acid and, optionally, additives, with a current intensity of between 1 and 100 A/dm$^2$;

d) rinsing with water at 60°C.

11 Claims, 1 Drawing Sheet

ELECTRICAL CONDUCTOR MADE OF COPPER-PLATED AND TIN-PLATED ALUMINUM

RELATED APPLICATION

Figure 1:
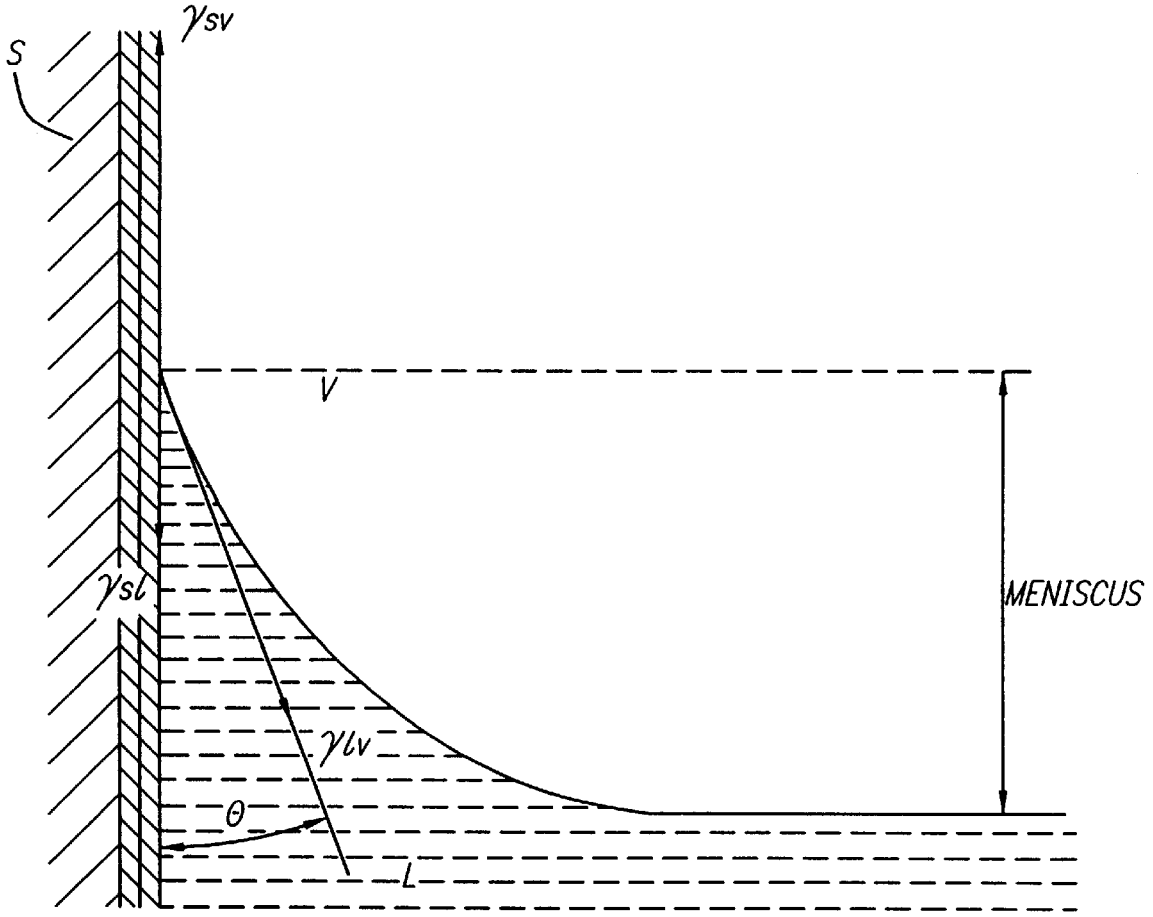

This application is a division of application Ser. No. 08/446,824, filed on Jun.1, 1995; now U.S. Pat. No. 5,665,219; which in turn was filed under 35 U.S.C. §371 from PCT/FR93/01148, filed on Nov. 22, 1993.

The present invention relates to a process for continuous manufacture of an electrical conductor at least partially based on aluminium coated with copper and tin.

The invention also relates to an electrical conductor consisting of an aluminium-based central core comprising a metal coating capable of being brazed and resistant to oxidation, consisting of a layer of copper and of a layer of tin.

Aluminium is a metal which offers a good compromise between conductivity, mechanical strength, mass and cost.

Use of conductors made of coated aluminium for manufacturing electrical cables is increasingly wide-spread in the aeronautics and space industries.

However, the development of aluminium conductors for small-section cables is more difficult and makes it necessary to solve a number of technical problems. The major difficulty stems from the fact that the aluminium central core must be coated to be capable of being resistant to oxidation and brazable with tin alloys. Now, the deposition of a metal layer on aluminium either by an electrolytic route or by immersion in a hot bath is found to be very difficult because of two phenomena which occur during the surface treatments.

The first relates to the chemical displacement of metals on the aluminium because the latter has a very negative electrochemical potential with regard to the majority of metals.

The second is the spontaneous formation of an oxide film on the aluminium surface, this happening even at ambient temperature.

These two phenomena prevent the metal layer from adhering well to the aluminium substrate.

As a result, during soft brazing operations with tin alloys at temperatures of between 210° C. and 250° C. the metal layer which bonds with the filler metal in the molten state tends to separate off from the substrate, thus resulting in a rupture of the soldered joint.

Enormous work has been done with a view to overcoming the difficulties encountered in electro-deposition on an aluminium wire. Some special treatment processes have been established which make it possible to deposit, for example, a nickel coating. However, nickel-coated aluminium wire exhibits a fairly mediocre brazability with tin solders, and this constitutes a major handicap for its electrical application. More recently, research conducted in this field has made it possible to carry out the electrodeposition of silver on an aluminium wire, and this gives it good brazability.

The paper "Electroplating on Aluminium Wire", pages 67–71 of the Transactions of the Institute of Metal Finishing, vol. 61 (1983) describes a process for electrochemical coating of an aluminium wire of 2.1 mm diameter with an underlayer of copper and a layer of tin.

This process consists in pretreating the surface of the aluminium substrate by immersion in various baths for degreasing and priming respectively.

The substrate is next coated with copper by electrodeposition in a first bath at 60° C., containing copper pyrophosphate and potassium pyrophosphate and then the copper coating itself is coated with tin by electrodeposition in a second bath, at ambient temperature, containing tin sulphate and sulphuric acid.

The analysis of the aluminium wire tin-plated according to this process shows that the adhesion between the copper underlayer and the aluminium substrate, as well as that between the tin layer and the copper underlayer are not satisfactory, and this results in problems of brazability of the conductor.

The brazability of a conductor wire is expressed as its wettability by a molten solder. In other words, the bonding of the molten filler metal to the conductor takes place correctly when the surface of the latter is wetted sufficiently by the said liquefied filler metal. The wettability is related to the so-called wetting angle formed by the surfaces of the conductor and of the solder meniscus respectively at their point of junction. The smaller the wetting angle, the better will be the wettability of the conductor in the solder employed.

It was thus found that the conductors coated according to the process described above did not have a satisfactory degree of wettability by the tin/lead solder alloys commonly employed.

In addition, in the case of very low aluminium substrate diameters (of the order of 0.1 mm) it is found that the adhesion of the metal coating is still less good and that the degree of wettability of the substrate (and hence the quality of the welds) reaches a particularly low level.

The objective of the present invention is to solve the above technical problems and, in particular, in the case of conductors which are very light and therefore of very small diameter.

This objective is attained in accordance with the invention by means of a process for continuous manufacture of an electrical conductor consisting of an at least partially aluminium-based central core, coated by electro-deposition with at least one metal layer including successively with intermediate rinsings the degreasing of the core, its pickling and the treatment of its surface in order to create thereon bonding points in the form of microscopic metal seeds, characterized in that the following are subsequently performed successively on the core, a) an electrochemical deposition of copper in an aqueous bath maintained at a temperature of between 20 and 60° C., containing KCN, CuCN, $K_2CO_3$ and $KNaC_4H_4O_6$ with a current intensity of between 1 and 10 A/dm$^2$,
b) rinsing at ambient temperature,
c) an electrochemical deposition of tin in an aqueous bath maintained at a temperature of between 20 and 60° C., containing essentially tin and methanesulphonic acid with a current intensity of between 1 and 100 A/dm$^2$, and
d) rinsing with water at 60° C.

According to an advantageous embodiment the degreasing is performed by an immersion for 4 to 100 s in an aqueous solution at 60° C., including:

from 5 to 40 g/l of NaOH
from 5 to 40 g/l of $Na_2CO_3$
from 1 to 20 g/l of $Na_3PO_4$
from 1 to 20 g/l of $Na_2SiO_3$
from 2 to 35 g/l of $C_6H_{11}NaO_7$ and the pickling is carried out by an immersion for 3 to 90 s in an aqueous solution at ambient temperature containing from 10 to 60% by volume of nitric acid.

In addition, the surface treatment of the conductor is performed in order to create bonding points by an immersion for 4 to 100 s in an aqueous solution maintained at a temperature of between 30 and 60° C., including from 50 to 200 ml/l of $Ni(BF_4)_2$ and from 10 to 80 ml/l of $Zn(BF_4)_2$.

According to advantageous characteristics the aqueous bath for the electrochemical deposition of Cu includes:

from 30 to 200 g/l of KCN from 20 to 100 g/l of CuCN from 5 to 50 g/l of $K_2CO_3$ from 10 to 100 g/l of $KNaC_4H_4O_6$ whereas the aqueous bath for the electrochemical deposition of tin includes:

from 5 to 50% of methanesulphonic acid from 1 to 100 g/l of metallic tin optionally from 20 to 200 ml/l of additives.

Another subject of the invention is an electrical conductor consisting of an at least partially aluminium-based central core comprising a metal coating which is brazable and resistant to oxidation, made up of an underlayer of copper and a layer of tin, characterized in that the wetting angle of the coated conductor is between 10° and 60°, depending on the diameter of the central core and the coating thickness.

According to an advantageous characteristic the thickness of the Cu underlayer is between 0.5 and 15 $\mu$m.

According to another characteristic the thickness of the Sn layer is between 0.5 and 15 $\mu$m.

According to yet another characteristic the diameter of the central core is between 0.08 and 2.0 mm.

The conductors of the invention are particularly well suited for the production of light cables with a view to applications especially in the aeronautics and space fields.

The conductor wire made of tin-plated aluminium is therefore obtained by a process of electrodeposition consisting in performing the following chemical and electrochemical treatments successively and continuously:

1) degreasing
2) rinsing
3) pickling
4) rinsing
5) preparation of the substrate
6) rinsing
7) copper-plating
8) rinsing
9) tin-plating
10) rinsing.

Stage 1) has a function of cleaning by degreasing the aluminium wire leaving the wire-drawing operation.

Stage 3) has a dual function consisting in, on the one hand, dissolving the aluminium oxide film and in neutralizing the possible film of liquid from the bath 1) on the aluminium wire.

The aim of stage 5) is to modify the surface quality of the wire by creating microscopic metal crystal seeds. This operation makes it possible to reduce appreciably the phenomenon of chemical displacement during the electrodeposition in the subsequent stages.

Stage 7) allows a film of copper to be deposited continuously by an electrolytic route. It has been chosen to create a barrier separating the aluminium substrate and the tin coating, and this allows the coated wire to be given advantageous properties. Thus, preliminary tests have shown that this copper underlayer considerably improves the brazability of the aluminium wire with tin alloy solders.

Stage 9) is intended to produce the final tin coating with a determined thickness.

Stages 7) and 9) for coating with Cu and Sn are performed with current intensities determined as a function of the required coating thicknesses and of the speed of travel or of the residence time of the conductor in the baths (Faraday's Law).

Stages 2), 4), 6), 8) and 10) are appropriate rinsings making it possible to remove the liquid entrained by the movement onto the wire, which could cause the contamination of the various treatment baths and thus reduce their lifetime.

The invention will be understood better on reading the description of the following examples:

EXAMPLE 1

A wire made of aluminium 131050 (Pechiney aluminium) of 0.51mm diameter was treated continuously according to the process of the invention, the composition of the baths thereof and the treatment conditions being described below.

1) Aqueous degreasing by an immersion for 28 s in a bath at 60° C. made up of:

| | |
|---|---|
| NaOH | 22.2 g/l |
| $Na_2CO_3$ | 20.0 g/l |
| $Na_3PO_4$ | 10.0 g/l |
| $Na_2SiO_3$ | 10.0 g/l |
| $C_6H_{11}NaO_7$ | 27.8 g/l |

2) Rinsing with water at ambient temperature

3) Aqueous pickling by an immersion for 20 s in a bath made of 30% of nitric acid at ambient temperature 4) Rinsing with water at ambient temperature 5) Aqueous treatment by an immersion for 28 s in a nickel fluoroborate and zinc fluoroborate bath at 40° C., in a proportion of

| | |
|---|---|
| Ni $(BF_4)_2$ | 95 ml/l |
| Zn $(BF_4)_2$ | 30 ml/l |

6) Rinsing with water at ambient temperature

7) Aqueous copper-plating at 40° C. with an electrolysis current of 6.8A/dm$^2$ by immersion for 20 s in a bath made up of

| | |
|---|---|
| KCN | 80 g/l |
| CuCN | 50 g/l |
| $K_2CO_3$ | 15 g/l |
| $KNaC_4H_4O_6$ | 50 g/l |

8) Rinsing with water at ambient temperature

9) Aqueous tin-plating at 35° C. with an electrolysis current of 3.0 A/dm$^2$ by immersion for 80 s in a bath made up of the following products:

| | |
|---|---|
| Methanesulphonic acid | 14% |
| Metallic tin | 50 g/l |
| Additives | 100 ml/l |

The tin-plating may also be carried out by means of a bath with three components which are marketed by the company Lea-Ronal under the references Solderon acide-Solderon étain-Solderon "make-up".

10) Rinsing with water at 60° C.

After the series of treatments the wire has a density of 2.78 g/cm$^3$ and a coating adherence conforming to international specifications. It is thus perfectly brazable with tin alloys.

EXAMPLE 2

A wire made of aluminium 5154 (standard NF-A-02104) of 0.102 mm diameter was treated according to the same process, with baths which had the same compositions with the same residence times in the baths and the same electrolysis current intensities as those in Example 1 above. The wire obtained after the treatments has a density of 3.40 g/cm$^3$. It has a coating adherence and a brazability which are similar to those of the wire in the preceding example. The trials and tests performed on the conductor screening produced with this wire in a coaxial cable have shown that the flexural and thermal aging behaviour, the brazability with tin alloys and the transfer impedence are satisfactory and comparable with those obtained with a copper wire.

With a view to comparing the products obtained according to the process of the present invention (Examples 1 and 2) with those obtained according to the prior art, insofar as the brazability is concerned, a series of meniscograph measurements of the wetting angle were carried out on conductor wires in which the diameters of aluminium 131050 (Pechiney) wire were from 0.1 mm and 2.0 mm with different thicknesses of copper and tin coatings.

The tests were conducted according to the specifications of French standardization (A 89-400-November 91) for brazability measurements, published by the Comité de Normalisation de la Soudure (CNS) [Committee for Standardization of Welding] and distributed by the AFNOR. This document, as well as the "test method" of the Union Technique de l'Electricité (1983) describe methods of determination of the wetting angle characteristic of the brazability of a conductor.

The principle of the measurement is the following:

Three phases are present during the brazing: the solid phase S (the article to be brazed), the liquid phase L (the molten filler alloy) and the vapour phase V (in most cases air or a gas flow). The molecular interactions between these phases taken in pairs are the surface tensions called: $\gamma_{sl}$ (solid-liquid), $\gamma_{lv}$ (liquid-vapour) and $\gamma_{sv}$ (solid-vapour). The relationship existing between these and the wetting angle θ formed by the surface of the solid and that of the liquid at their intersection is given by the formula:

$$\cos\theta = \frac{\gamma_{sv} - \gamma_{sl}}{\gamma_{lv}} \quad \text{(FIG. 1)}$$

In the present case the article to be brazed S is the coated conductor according to the present invention.

The smaller the wetting angle, the better is the brazability of the conductor.

Thus, still according to French standardization, provision is made for the quality of the brazability to be categorized into four classes.

| Brazability class | Wetting angle (°) |
|---|---|
| 1 very good | 0 ≦ 30 |
| 2 good | 0 ≦ 40 |
| 3 acceptable | 0 ≦ 55 |
| 4 weak to bad | 0 > 55 |

Measurements in a meniscograph were performed on a bath of Sn63-Pb 37 filler alloy (solidus T 183°C. liquidus T 183° C.) incorporated in the meniscograph and heated to 235° C., the wires being immersed beforehand in a nonactive neutral flux characterized by its surface tension of 0.38 mN/mm for 2 seconds.

The intensity of the electrolysis current in the case of the copper-plating and tin-plating baths was 1 A/dm$^3$ for all the samples.

The surface preparation stages (stages 1, 3, 5) were performed under the same conditions as in the case of Examples1 and 2 (same bath compositions, same residence times etc).

In the case of the copper-plating and tin-plating operations the residence times in the baths are determined by Faraday's Law from the current intensity and the required thicknesses for the Cu coating and the Sn coating (these thicknesses are given in Table I below).

TABLE I

| | Sample No. | Diameter of A1 wire (mm) | Cu thickness (μm) | Sn thickness (μm) | Wetting angle (degree °) | Densities (g/cm$^3$) |
|---|---|---|---|---|---|---|
| Prior art | 30 | 2.0 | 0.5 | 0.2 | 134 | 2.71 |
| | 31 | 2.0 | 2.0 | 1.0 | 134 | 2.73 |
| | 32 | 2.0 | 2.0 | 10.0 | 134 | 2.81 |
| | 33 | 0.1 | 1.0 | 2.0 | 149 | 3.25 |
| Invention | 34 | 2.0 | 0.5 | 0.2 | 57 | 2.71 |
| | 35 | 2.0 | 2.0 | 1.0 | 44 | 2.73 |
| | 36 | 2.0 | 2.0 | 10.0 | 30 | 2.81 |
| | 37 | 0.1 | 1.0 | 2.0 | 46 | 3.25 |
| | 38 | 2.0 | 5.0 | 10.0 | 18 | 2.85 |
| | 39 | 2.0 | 5.0 | 15.0 | 10 | 2.89 |

I claim:

1. An electrical conductor comprising:

a central core comprised of aluminum, and a metal coating on said central core which is resistant to oxidation and is brazable, said metal coating comprising an underlayer of copper and a layer of tin, wherein the wetting angle formed between the surface of the electrical conductor and a surface of a meniscus of a solder at their point of junction is between 10° and 60°.

2. The conductor as recited in claim 1, wherein the thickness of the copper underlayer is between 0.5 and 15 micrometers (μm).

3. The conductor as recited in claim 1, wherein the thickness of the tin layer is between 0.5 and 15 micrometers (μm).

4. The conductor as recited in claim 1, wherein a diameter of the central core is between 0.08 and 2.0 millimeters (mm).

5. An electrical conductor comprising:

a central core comprised of aluminum, said central core having a thickness between 0.08 and 2.0 millimeters (mm); and a metal coating on said central core which is resistant to oxidation and is brazable, said metal coating comprising an underlayer of copper having a thickness between 0.5 and 15 micrometers (μm), and a layer of tin having a thickness between 0.5 and 15 micrometers (μm);

wherein the wetting angle formed between the surface of the electrical conductor and a surface of a meniscus of a solder at their point of junction is between 10° and 60°.

6. An electrical conductor comprising:

a central core comprised of aluminum, said central core having bonding points in the form of microscopic metal seeds formed by, successively with intermediate rinsings, degreasing of the core, pickling and surface treatment; and a metal coating on said central core which is resistant to oxidation, is brazable, and has a wetting angle between 10° and 60°, said metal coating being applied by a process comprising the following steps:

electronchemically depositing copper on the conductor in a first aqueous bath maintained at a temperature of between 20° C. and 60° C., containing KCN, CuCN, $K_2CO_3$ and $KNaC_4H_4O_6$ with a current intensity of between 1 and 10 Amperes per square decimeter ($A/dm^2$), rinising the conductor at ambient temperature, electrochemically depositing tin on the conductor in a second aqueous bath maintained at a temperature of between 20° C. and 60° C., containing essentially tin and methanesulphonic acid and, optionally, additives, with a current intensity of between 1 and $100A/dm^2$, and rinising the conductor with water at 60° C.

7. The conductor as recited in claim 6 wherein the conductor is degreased by immersing the conductor for 4 to 100 seconds (s) in an aqueous solution at 60° C including:

from 5 to 40 grams per liter (g/l) of NaOH, from 5 to 40 g/l of $Na_2CO_3$, from 1 to 20 g/l of $Na_3PO4$, from 1 to 20 g/l of $Na_2SiO_3$, and from 2 to 35 g/l of $C_6H_{11}NaO_7$.

8. The conductor as recited in claim 6 wherein the conductor is pickled by immersing the conductor for 3 to 90 seconds in an aqueous solution at ambient temperature, containing from 10% to 60% by volume of nitric acid.

9. The conductor as recited in claim 6, wherein the surface treatment of the conductor is performed by immersing the conductor for 4 to 100 s in an aqueous solution maintained at a temperature of between 30° C., and 60° C., including from 50 to 200 milliliters per liter (ml/l) of nickel fluoroborate and from 10 to 80 ml/l of zinc fluoroborate.

10. The conductor as recited in claim 6, wherein the first aqueous bath comprises:

from 30 to 200 g/l of KCN, from 20 to 100 g/l of CuCN, from 5 to 50 g/l of $K_2CO_3$, and from 10 to 100 g/l of $KNaC_4H_4O_6$.

11. The conductor as recited in claim 6, wherein the second aqueous bath includes from 5 to 50% by volume of methanesulphonic acid in which are dissolved 1 to 100 g/l of tin and, optionally, additives.

* * * * *